United States Patent [19]

Kameyama

[11] Patent Number: 5,066,253

[45] Date of Patent: Nov. 19, 1991

[54] ELECTRIC CONNECTOR WITH A TERMINAL LOCKING MECHANISM

[75] Inventor: Isao Kameyama, Shizuoka, Japan

[73] Assignee: Yazaki Corporation, Tokyo, Japan

[21] Appl. No.: 663,528

[22] Filed: Mar. 4, 1991

[30] Foreign Application Priority Data

Mar. 19, 1990 [JP] Japan ..... 2-67347

[51] Int. Cl.[5] ..... H01R 13/514

[52] U.S. Cl. ..... 439/752; 439/595

[58] Field of Search ..... 439/594, 595, 752

[56] References Cited

U.S. PATENT DOCUMENTS

| | | | |
|---|---|---|---|
| 4,921,448 | 5/1990 | Endo et al. | 439/595 |
| 4,944,688 | 7/1990 | Lundergan | 439/595 X |
| 4,946,398 | 8/1990 | Takenouchi et al. | 439/599 |

*Primary Examiner*—Eugene F. Desmond

*Attorney, Agent, or Firm*—Armstrong, Nikaido, Marmelstein, Kubovcik & Murray

[57] ABSTRACT

An electric connector with a locking mechanism comprises: a connector housing provided with an upper terminal chamber accommodating upper terminals and lower terminal chamber accommodating lower terminals; and a terminal locking member capable of being joined to the rear end of the connector housing in a temporarily assembled state or in a completely assembled state. The terminal locking member is provided with terminal holding fingers which are bent up by the terminals inserted in the upper terminal chamber so that the tips thereof are brought into abutment with stopping steps formed in the inner surface of the upper terminal chamber to prevent the further advancement of the terminal locking member from the temporarily assembled state relative to the connector housing if the terminals are not inserted correctly in the upper chamber. Therefore, the unlocking projection is unable to think in the upper terminal chamber and rests on the outer surface of the upper wall of the connector housing when the terminals are not inserted correctly in the upper terminal chamber.

3 Claims, 5 Drawing Sheets

ELECTRIC CONNECTOR WITH A TERMINAL LOCKING MECHANISM

BACKGROUND OF THE INVENTION

1. Field of the Invention

The present invention relates to an electric connector for connecting wire harnesses and, more particularly to an electric connector provided with a terminal locking mechanism capable of locking mating terminals. 1

2. Description of the Prior Art

FIG. 4 shows a conventional electric connector. The electric connector has a connector housing a accommodating female terminals b. Each female terminal b has a tongue $b_1$ engaging a step $a_1$ formed on the inner surface of the connector housing a to restrain the female terminal b from backward movement. When a tab-shaped male terminal e is inserted in the female terminal b, a locking projection $c_1$ formed in an elastic contact plate c engages a locking hole $e_1$ formed in the male terminal e to lock the male terminal e in place. In extracting the male terminal e from the female terminal b, a flexible unlocking tab f formed in the connector housing a is depressed to depress an unlocking lug $c_2$ so that the elastic contact plate c is bent downward to disengage the locking projection $c_1$ from the locking hole $e_1$.

In this electric connector, the male terminal e may not possibly be locked in place if the female terminal b is not disposed correctly in the connector housing a.

SUMMARY OF THE INVENTION

Accordingly, it is an object of the present invention to provide an electric connector provided with a locking mechanism capable of surely locking mating terminals at a correct position in its connector housing.

In one aspect of the present invention, an electric connector comprises a connector housing having a terminal chamber, and a terminal locking member having terminal locking fingers and capable of being joined to the rear end of the connector housing in a temporarily assembled state and in a completely assembled state. The terminal locking member has a flexible unlocking lever having a terminal unlocking nose capable of entering the terminal chamber through an opening formed in a wall of the connector housing. The terminal unlocking nose projects from the wall of the connector housing when the terminal locking member is combined with the connector housing in the temporarily assembled state, and sinks through the opening in the terminal chamber when the terminal locking member is combined with the connector housing in the completely assembled state.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

Figure 1:
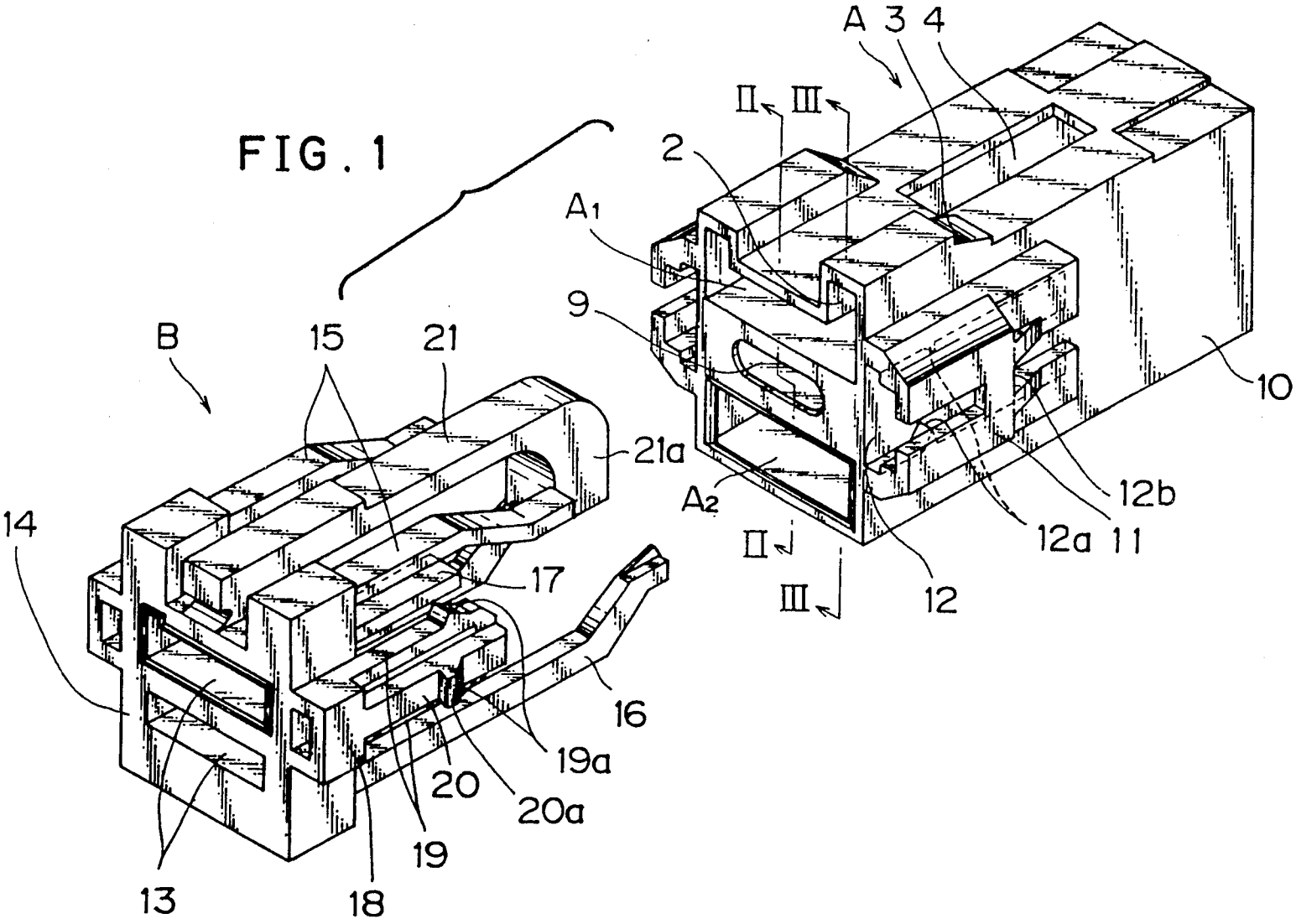
FIG. 1 is an exploded perspective view of an electric connector with a locking mechanism in a preferred embodiment according to the present invention.

Referring to the drawings, an electric connector in a preferred embodiment according to the present invention comprises a connector housing A formed by molding a synthetic resin, and a terminal locking member B formed by molding a synthetic resin.

Figure 3A:
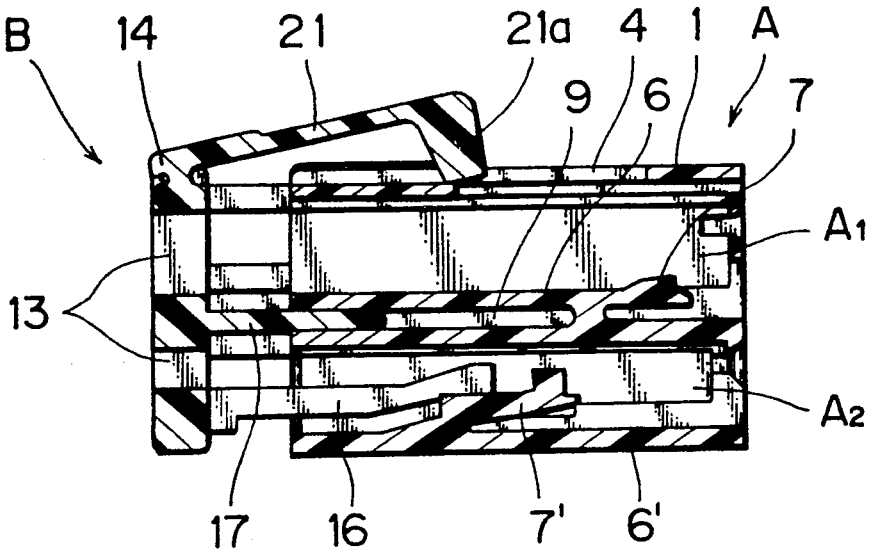
FIGS. 3*a* and 3*b* are sectional views taken on line II—II in FIG. 1 in a temporarily assembled state and in a completely assembled state, respectively, of the electric connector.
Figure 3B:
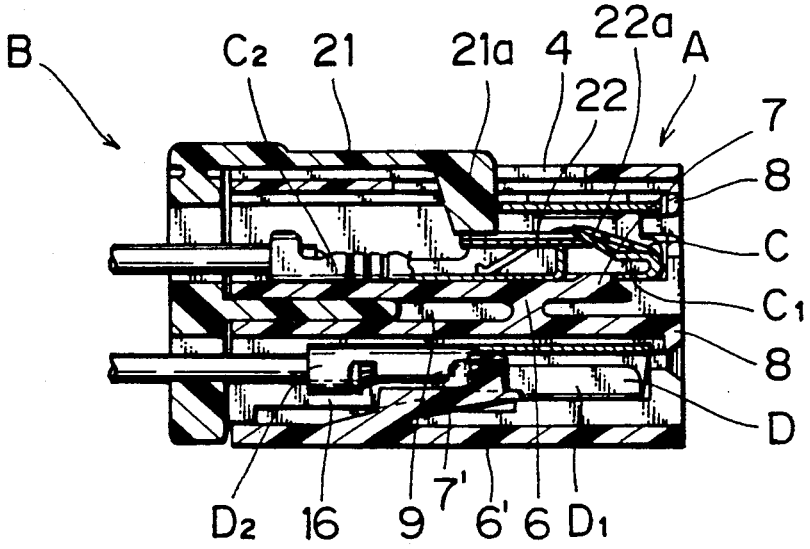

As shown in FIG. 1, the connector housing A is provided with an upper terminal chamber $A_1$ and a lower terminal chamber $A_2$ respectively for accommodating terminals C and D differing from each other in construction. Longitudinal guide grooves 2 are formed in the rear portion of the upper wall 1 of the upper terminal chamber $A_1$. Stopping steps 3 are formed at the front ends of the guide grooves 2, respectively. An opening 4 is formed in the middle portion of the upper wall 1 of the connector housing A. As shown in FIGS. 3*a* and 3*b*, the upper terminal chamber $A_1$ and the lower terminal chamber $A_2$ are separated from each other by a middle wall 6. Flexible locking fingers 7 and 7′ for locking terminals C and D are formed in the middle wall 6 and the lower wall 6′ of the connector housing A, respectively. Stoppers 8 are formed on the front wall of the connector housing A to restrain the terminals C and D from slipping out of the front of the connector housing A. A guide hole 9 for receiving a positioning tongue 17 formed on the terminal locking member B is formed in the middle wall 6 separating the upper terminal chamber $A_1$ and the lower terminal chamber $A_2$ from each other. Protrusions 11 are formed on the opposite side walls 10 of the connector housing A, respectively. Grooves 12 are formed in the protrusions 11 to receive locking fingers 20 formed on the terminal locking member B, respectively. Each groove 12 is provided with temporary locking projections 12*a* and a locking projection 12*b*.

The terminal locking member B has a main body 14 provided with holes 13 through which terminals and wires connected to the terminals are passed, terminal holding fingers 15 forwardly projecting from the main body 14 and bent downward at a forward portion thereof so as to be inserted in the upper terminal chamber $A_1$ without interference with the stopping steps, terminal holding fingers 16 projecting to the front from the main body 14 so as to be inserted in the lower terminal chamber $A_2$, the positioning tongue 17 to be inserted in the guide hole 9, and locking arms 18. Each locking arm 18 consists of vertically flexible fingers 19 each provided with a locking projection 19*a*, and a horizontally flexible finger 20 provided with a locking projection 20*a*. A flexible unlocking lever 21 is supported at its rear end on the upper wall of the main body 14 of the terminal locking member B so as to extend along the outer surface of the upper wall of the connector housing A. The unlocking lever 21 is provided at its free end with an unlocking projection 21*a* projecting toward the connector housing A. In unlocking mating terminals, the unlocking projection 21*a* of the unlocking lever 21 is pressed into the upper terminal chamber $A_1$.

Figure 2:
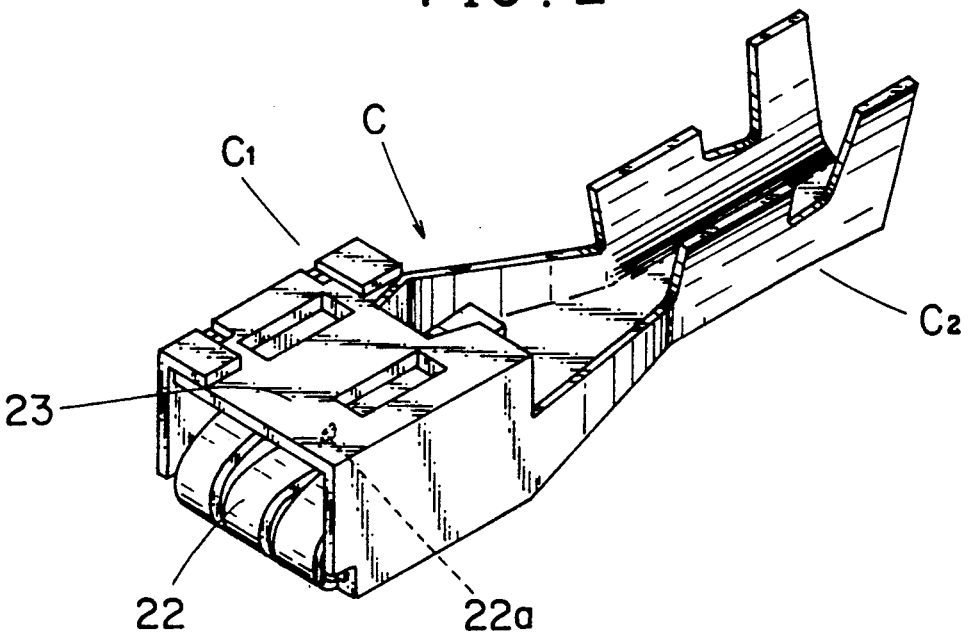
FIG. 2 is a perspective view of a terminal to be accommodated within the electric connector shown in FIG. 1.

As shown in FIG. 2, the female terminal C has a contact portion $C_1$ and a wire connecting portion $C_2$. In the contact portion $C_1$, an elastic contact plate 22 having a locking lug 22*a* to engage the male terminal is bent from the forward middle portions of the base of the contact portion $C_1$ as shown in FIG. 2 to extend over the base portion $C_1$. Further, one of the sides of the base of the contact portion $C_1$ is bent to extend and further be turned over above the elastic contact plate 22 to form an upper wall 23 of the contact portion $C_1$. The upper wall 23 snugly fits inside the upper terminal chamber $A_1$.

The female terminal D has an ordinary tubular contact portion $D_1$ and a connecting portion $D_2$.

Figure 4A:
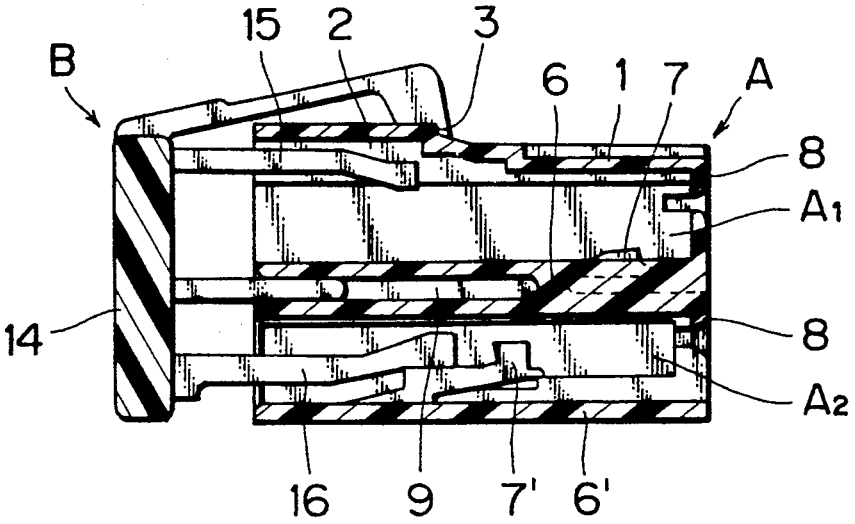
FIGS. 4*a*, 4*b* and 4*c* are sectional views taken on line III—III in FIG. 1, showing a temporarily assembled state, a completely assembled state and a temporarily assembled state with a terminal in an incompletely inserted state, respectively.

In the temporarily assembled state shown in FIGS. 3*a* and 4*a*, the locking projections 19*a* of the locking projections 18 of the terminal locking member B are in engagement with the temporary locking projections 12*a* of the groove 12 of the connector housing A, and the unlocking projection 21*a* of the flexible unlocking lever 21 rests on the upper surface of the upper wall 1 of the connector housing A.

In the temporarily assembled state, the female terminals C and D are inserted in the terminal chambers $A_1$ and $A_2$, respectively, and the female terminals D are locked in place by the locking fingers 7.

Figure 4B:
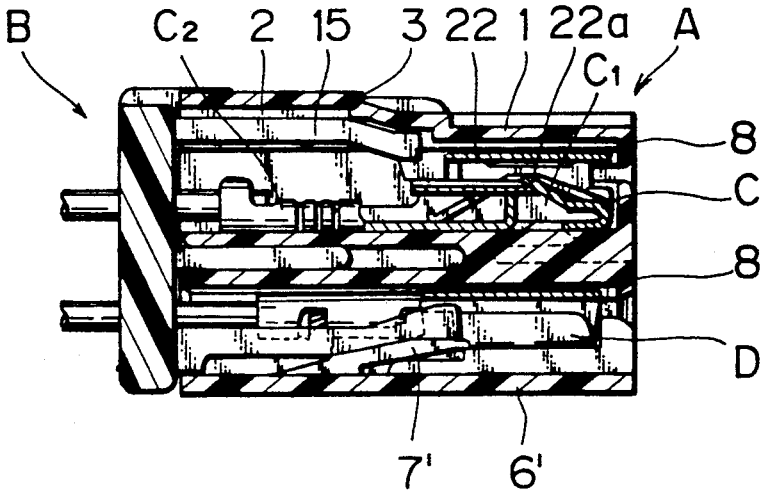

The terminal locking member B is pushed further toward the connector housing A to combine the terminal locking member B completely with the connector housing A with the locking projections 20*a* of the locking arms 18 in engagement with the corresponding locking projections 12*b* of the grooves 12, with the terminal holding fingers 15 in engagement with the rear portion of the ceiling the contact portions $C_1$ of the female terminals C and with the rear portion of the terminal holding fingers 16 in engagement with the contact portions $D_1$ of the female terminals D. In this state, the unlocking projection 21*a* of the flexible unlocking lever 21 is received in the opening 4 and is positioned above the elastic contact plate 22 as shown in FIGS. 3*a* and 4*b*.

Figure 4C:
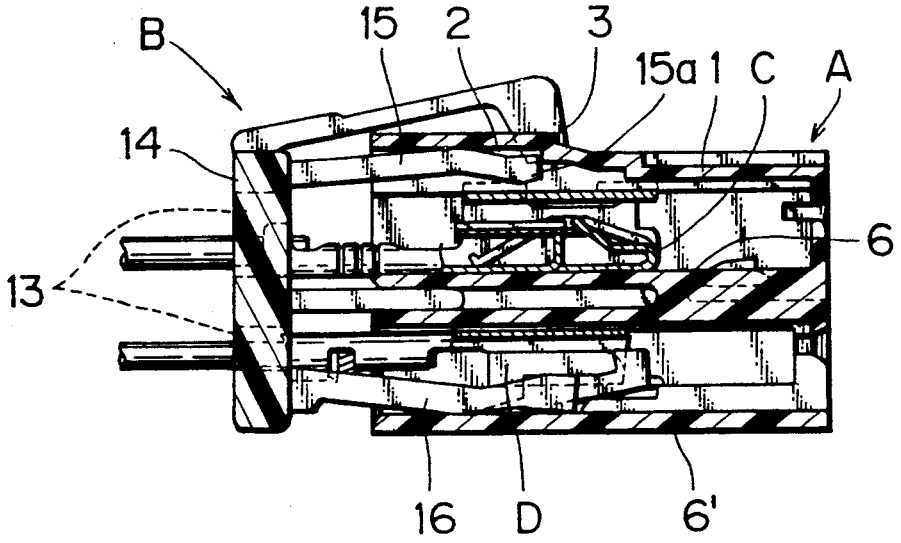
Figure 5:
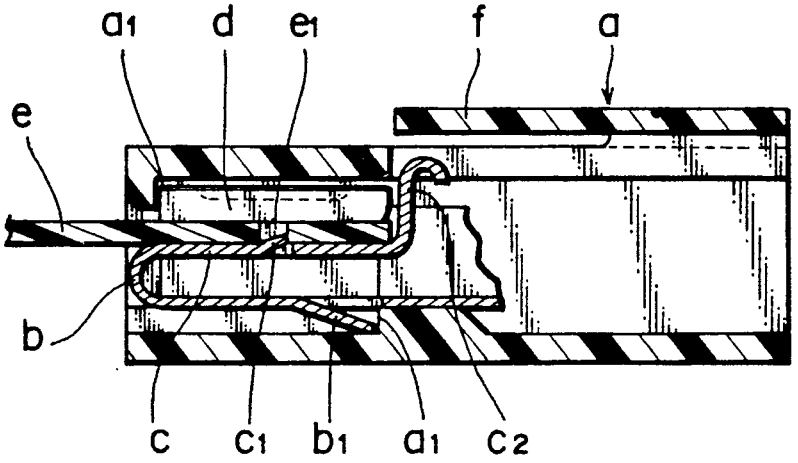
FIG. 5 PRIOR ART
FIG. 5 is a sectional view of a conventional electric connector.

When the female terminals C are not inserted correctly in the connector housing A in the temporarily assembled state, the terminal holding fingers 15 of the terminal locking member B are deflected upward by the upper wall 23 of the contact portions $C_1$ of the female terminals C so that the tips 15*a* of the terminal holding fingers 15 are in abutment respectively with the stopping steps 3 as shown in FIG. 4*c* to prevent the further advancement of the terminal locking member B relative to the connector housing A. Thus the connector housing A and the terminal locking member B cannot be assembled completely if the female terminals C are not inserted correctly in the terminal chamber $A_1$.

As is apparent from the foregoing description, an electric connector in accordance with the present invention comprises: a connector housing provided with an upper terminal chamber and a lower terminal chamber; a terminal locking member capable of being joined to the rear end of the connector housing in a temporarily assembled state or in a completely assembled state and having terminal holding fingers to be inserted in the terminal chamber, and a flexible unlocking lever provided at its extremity with an unlocking projection which rests on the outer surface of the upper wall of the connector housing in the temporarily assembled state and sinks through an opening formed in the upper wall of the connector housing in the upper terminal chamber in the completely assembled state; female terminals inserted in the lower terminal chambers; and female terminals inserted in the upper terminal chamber, and capable of bending up the terminal holding fingers when they are not inserted correctly in the upper chambers so that the tips of the terminal holding fingers are in abutment with stopping steps formed on the inner surface of the upper wall of the connector housing to prevent the further advancement of the terminal locking member from a position in the temporarily assembled state relative to the connector housing. Accordingly, the incorrect insertion of the female terminals in the terminal chamber can readily be known from the position of the locking projection of the flexible locking lever.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An electric connector with a locking mechanism, comprising:

a connector housing provided with at least one terminal chamber to accommodate herein a terminal and having at an upper wall thereof an opening communicating with said at least one terminal chamber;

a terminal locking member having a terminal holding finger adapted to be inserted into said at least one terminal chamber, said terminal locking member being capable of being joined to said connector housing at a rear end thereof in a temporarily assembled state and in a completely assembled state;

characterized in that the terminal locking member is provided with a flexible unlocking lever having at its free end an unlocking projection, said unlocking projection rests on said upper wall of the connector housing in the temporarily assembled state and the unlocking projection sinks through said opening in the upper wall into said at least one terminal chamber in the completely assembled state.

2. An electric connector according to claim 1, wherein said upper terminal chamber is formed with a guide groove having a stopping step at a forward end thereof, said at least one terminal holding finger forwardly projecting and bent downward at a forward portion thereof such that said terminal holding fingers avoid interference with said stopping step in the temporarily and completely assembled states.

3. An electric connector according to claim 2, wherein said terminal is provided with an upper wall to deflect said at least one terminal holding finger to interfere with said stopping step in case of incomplete terminal insertion.

* * * * *